United States Patent [19]

Douty et al.

[11] 4,350,402

[45] Sep. 21, 1982

[54] BOARD MOUNT ZERO INSERTION FORCE CONNECTOR

[75] Inventors: George H. Douty, Mifflintown; John M. Landis, Lemoyne; Leon T. Ritchie, Mechanicsburg, all of Pa.

[73] Assignee: AMP Incorporated, Harrisburg, Pa.

[21] Appl. No.: 187,647

[22] Filed: Sep. 17, 1980

[51] Int. Cl.[3] ..... H01R 13/62

[52] U.S. Cl. ..... 339/74 R; 339/192 R

[58] Field of Search ..... 339/74 R, 75 M, 75 MP, 339/192 R

[56] References Cited

U.S. PATENT DOCUMENTS

| | | | |
|---|---|---|---|
| Re. 29,223 | 5/1977 | Pritulsky | 339/75 MP |
| 3,665,370 | 5/1972 | Hartmann | 339/75 MP |
| 3,865,457 | 2/1975 | Carter | 339/74 R |
| 3,899,234 | 8/1975 | Yeager et al. | 339/74 R |
| 4,047,791 | 9/1977 | Carter | 339/260 |
| 4,067,633 | 1/1978 | Groft et al. | 339/74 R |
| 4,077,688 | 3/1978 | Cobaugh et al. | 339/74 R |
| 4,080,032 | 3/1978 | Cherian et al. | 339/75 M |
| 4,189,200 | 2/1980 | Yeager et al. | 339/75 MP |

*Primary Examiner*—Neil Abrams

*Attorney, Agent, or Firm*—Russell J. Egan

[57] ABSTRACT

A board mounted zero insertion force connector is disclosed. The connector has an actuator plate carrying a cam, a cam follower adjacent the actuator plate and responsive to movement of the cam, a terminal housing moved by the cam follower and carrying a plurality of terminals, and an outer housing against which contact arms of the terminals act and which holds the actuator plate in a fixed position against movement of the cam. The connector operates to spread the contact arms of the terminals carried thereby to allow mating with a plurality of fixed pins. The connector cam can either be directly actuated or remotely actuated.

9 Claims, 5 Drawing Figures

BOARD MOUNT ZERO INSERTION FORCE CONNECTOR

BACKGROUND OF THE INVENTION

1. The Field Of The Invention

The present invention relates to zero insertion force connectors and in particular to a connector to be mounted on the edge of a printed circuit board to make a mother/daughter board interconnect.

2. The Prior Art

There are many well known zero insertion force connectors all of which act in a somewhat similar manner in that a cam and/or cam follower acts on pairs of spaced terminals or contact arms of terminals to spread them so as to receive a mating member therein. Examples of the former can be found in U.S. Pat. Nos. 3,665,370; 3,899,234; Re 29,223; 4,077,688 and 4,189,200. Examples of the latter can be found in U.S. Pat. Nos. 3,865,457; 4,047,791; 4,067,633 and 4,080,032.

SUMMARY OF THE INVENTION

The present invention is intended to be mounted on the edge of a printed circuit board to allow zero force mating with a fixed pin array of another board. The subject connector has a fixed outer housing enclosing a terminal carrying housing which is movable with respect to the outer housing. An actuator plate encloses the terminal housing within the outer housing and carries a cam member. A cam follower is disposed between the actuator plate and the terminal housing and is responsive to cam movement to effect relative movement between the outer and terminal housings. The terminal housing carries a plurality of terminals each of which has a pair of contact arms which engage wedges in the outer housing and cause an opening and closing of the contact arms upon relative movement of the housings.

It is therefore an object of the present invention to produce an improved board mounted zero insertion force connector.

It is a further object of the present invention to produce an improved board mounted zero insertion force connector which can be directly or remotely actuated.

It is another object of the present invention to produce an improved zero insertion force connector in which a plurality of terminals are simultaneously actuated to an open condition to receive a like array of pin terminals therein.

It is a further object of the present invention to produce a board mounted zero insertion force connector which can be readily and economically manufactured.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
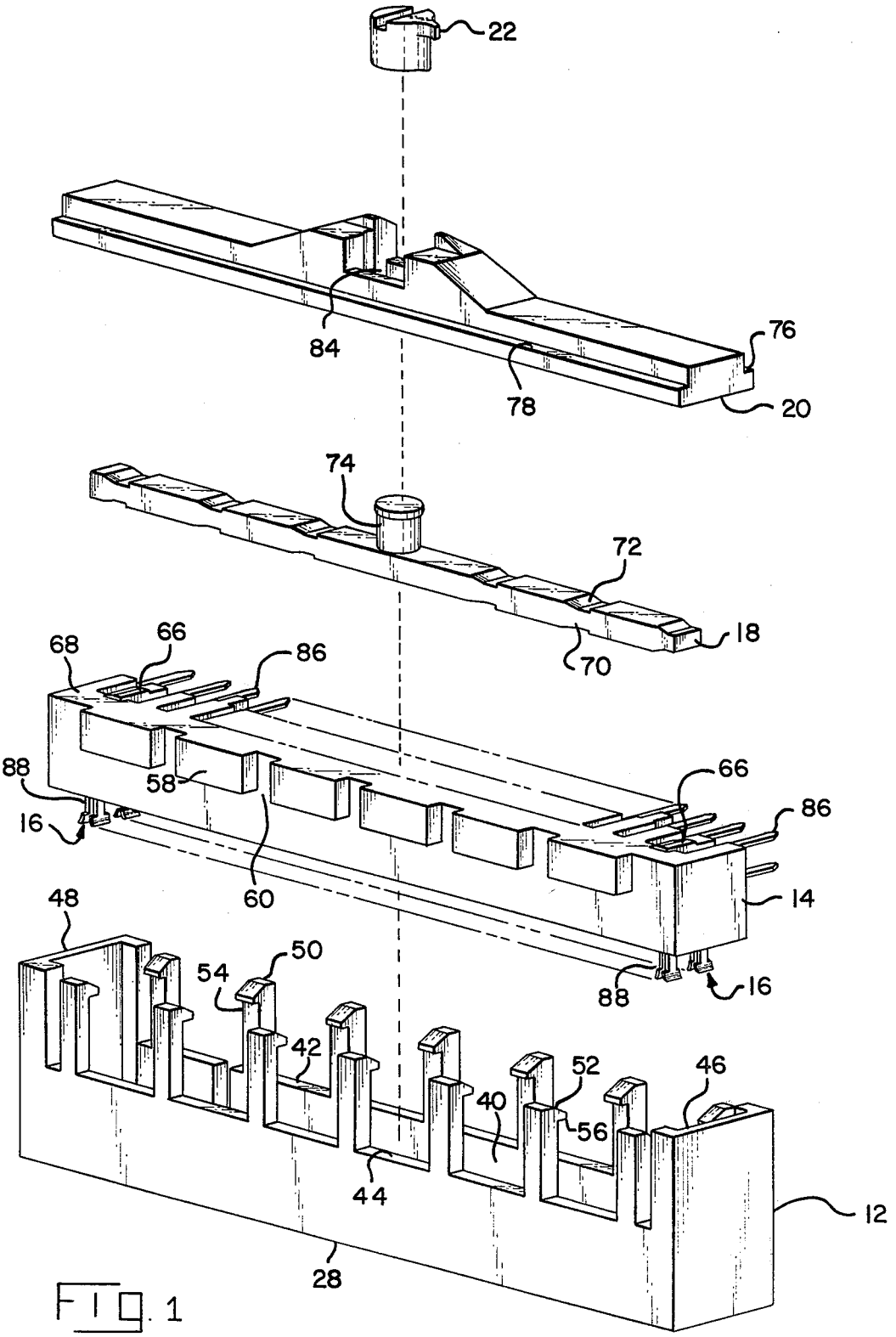
FIG. 1 is an exploded perspective view of the board mounted zero insertion force connector according to the present invention.

The subject connector 10 comprises an outer housing 12, a terminal housing 14 carrying a plurality of terminals 16, a cam follower 18, an actuator plate 20, and a cam 22. The cam 22 can be actuated by a remote cam drive 24 and the entire connector 10 is mounted on a printed circuit board 26.

The outer housing 12 has a generally rectangular elongated profile with a mating face 28 having a plurality of profiled apertures 30 therein. Each aperture 30 (see FIGS. 3 and 4) has an inwardly tapering entry 32, at the mating face 28, leading to a bore 34 which extends through a pair of inclined actuating surfaces 36, 38. The rear of the outer housing forms an open cavity 40 defined by parallel spaced side walls 42, 44 and end walls 46, 48. Each side wall has a plurality of upstanding legs 50, 52 each with an inwardly directed shoulder 54, 56, respectively, adjacent the free end thereof. The end walls 46, 48 each have an inwardly directed channel profile.

Figure 5:
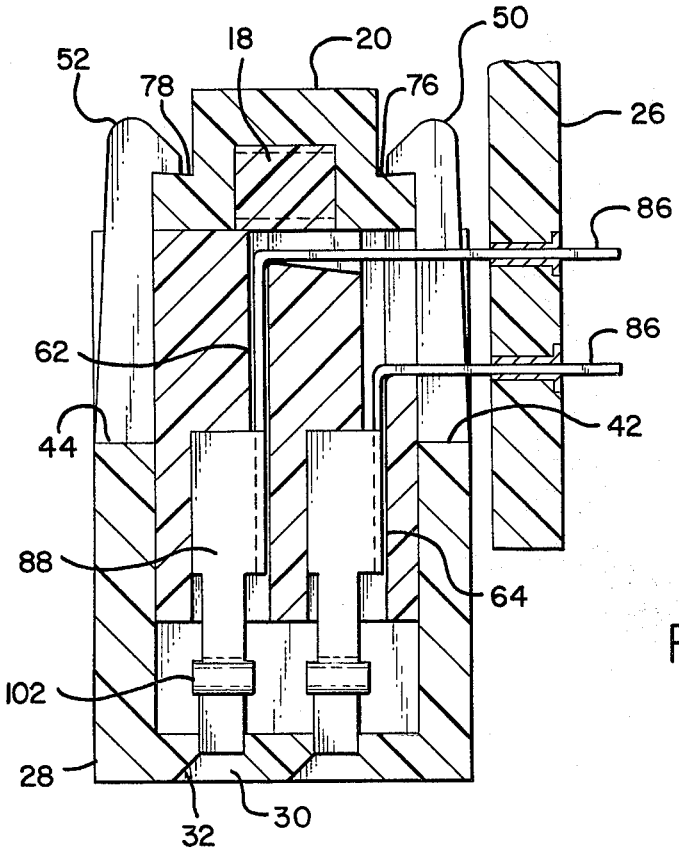
FIG. 5 is a transverse section through the subject connector in a deactivated condition.

The terminal housing 14 is a generally rectangular elongated block dimensioned to be received in the cavity 40 and with a plurality of lateral extensions 58 defining grooves 60 therebetween, which grooves 60 correspond in number and spacing to the legs 50, 52. The terminal housing also includes a plurality of terminal passages 62, 64 (see FIG. 5) each aligned with a respective aperture 30 in the outer housing 12. The terminal housing further has a plurality of cam ramps 66 on the rear surface thereof 68.

The cam follower 18 is an elongated member having a plurality of ramp surfaces 70, 72 on bottom and top surfaces thereof, respectively. The cam follower also includes an integral cam shaft 74.

The actuator plate 20 is an elongated member sized to be received between the end walls 46, 48 and with outwardly directed longitudinal shoulders 76, 78 which latchingly engage with the shoulders 54, 56 of the legs 50, 52, respectively. The actuator plate 20 also has an inwardly directed cavity 80 (see FIGS. 3 and 4) having a plurality of ramp surfaces 82 corresponding to the ramp surfaces 72 on cam follower 18. The actuator plate 20 also includes a centrally disposed aperture 84 which receives the cam 22 and against which the cam acts to effect transverse movement of the cam follower 18 with respect to the terminal housing 14, outer housing 12, and actuator plate 20.

Each contact 16 is preferably stamped and formed from conventional sheet metal stock and includes a printed circuit board engaging extension 86 and a mating front end 88. The mating front end 88 of each contact 16 is essentially channel shaped with a base 90 and a pair of parallel spaced side walls 92, 94. A locking lance (not shown) can be struck from the base to secure the terminal in the housing. A pair of mating spring arms 96, 98 extend forwardly from the side walls 92, 94, respectively. On the free end of each arm 96, 98 there is an outwardly curved enlargement 100, 102, respectively, (see FIGS. 1 and 5) which are normally in close proximity and define therebetween a flaring entry to the channel. It will be noted from FIG. 5 that the enlargements 100, 102 are of greater width than the spring arms 96, 98 so as to engage the contact actuating surfaces 36, 38 of the outer housing 12 to either side of the apertures 30.

Figure 2:
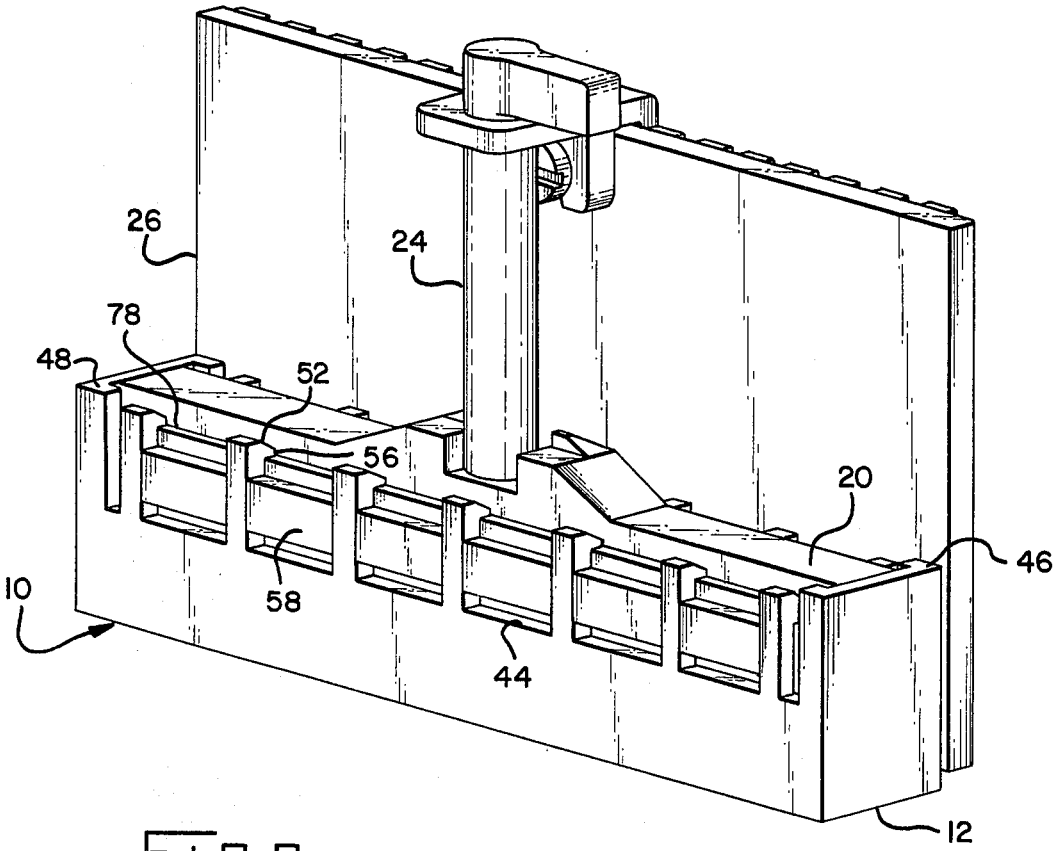
FIG. 2 is a perspective view of the subject zero insertion force connector mounted on a circuit board together with a remote actuating means.

The connector is assembled by first loading the terminals 16 into the housing 14. The terminal housing 14 is then placed into the cavity 40 of the outer housing 12 with the extensions 58 lying between the legs 50, 52 which serve to both stabilize and guide the terminal housing 14 during its movement. The cam follower 18 is then placed on the rear surface 68 of the terminal housing 14 and the actuator plate 20 is placed over it with the shoulders 76, 78 engaging the respective shoulders 54, 56 of the legs 50, 52. The cam 22 is also inserted into the actuator plate 20. The entire assembly can then be mounted in conventional fashion on the edge of a printed circuit board 26 or the like by soldering extensions 86 to the circuitry of the board. As shown in FIG. 2, a remote actuator 24 for the cam can be applied if this is desirable.

Figure 3:
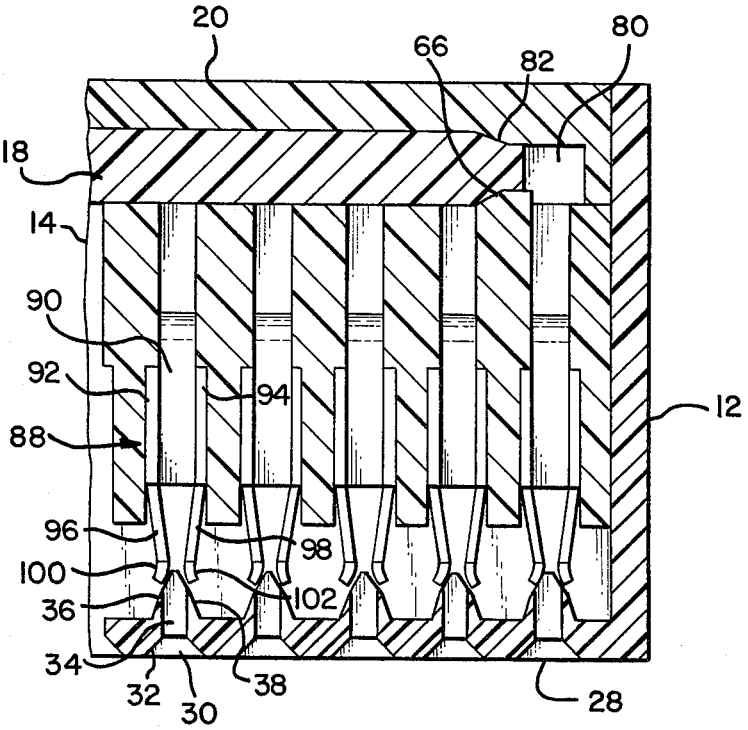
FIG. 3 is a partial longitudinal section through one end of the subject connector in a deactivated condition.
Figure 4:
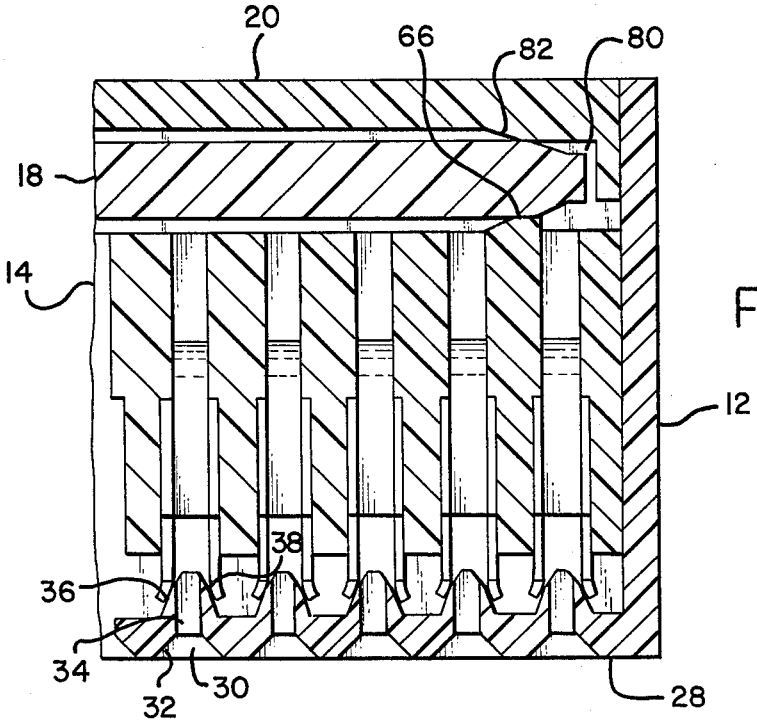
FIG. 4 is a section similar to FIG. 3 showing the subject connector in an actuated condition.

FIGS. 3 and 4 show the operation of the subject connector. In FIG. 3 the terminals 16 are shown in a relaxed condition in which the spring arms 96, 98 are sufficiently closely spaced to grasp opposite sides of a pin terminal (not shown) inserted therein. Rotation of the cam 22 effects a transverse movement of the cam follower 18 to the position shown in FIG. 4 in which the terminal housing 14 achieves relative motion with respect to the outer housing 12 with the actuating surfaces 36, 38 of the outer housing 12 extending between the enlargements 100, 102 of the terminal spring arms 96, 98 to spread them to an open pin receiving condition. It will be readily appreciated that in this condition a pin terminal (not shown) can readily be received in the terminal 16 with substantially no insertion force being applied. Return of the cam 22 to its initial position will drive the cam follower back to the position shown in FIG. 3 and allow spring arms 96, 98 to drive the terminal housing 16 away from the outer housing 12 and allow the terminals to close. It should be also noted that this closing movement of the terminals causes the spring arms to make a wiping engagement with the respective pin or post terminals received therebetween.

The present invention may be subject to many modifications and changes without departing from the spirit or essential characteristics thereof. The foregoing description should therefore be considered as illustrative only and not restrictive of the scope of the invention.

What is claimed is:

1. A zero insertion force connector comprising:

an outer housing having a mating front face and an oppositely directed rear face, a cavity opening into said rear face, a plurality of profiled terminal passages extending from said mating face to said cavity and at least one reaction surface adjacent each said terminal passage facing into said cavity;

a terminal housing profiled to be received in said cavity and having therein a plurality of profiled terminal receiving passages each aligned with a respective terminal passage in said outer housing, and at least one cam surface on a rear surface of said terminal housing;

a cam follower having at least one cam surface aligned to engage a respective cam surface of said terminal housing;

an actuator plate profiled to be received in said outer housing with an inwardly directed cavity receiving said cam follower;

a cam member movably mounted in said actuator plate to act against said actuator plate to effect movement of said cam follower and said terminal housing with respect to said outer housing; and a plurality of spring contacts each received in a respective one of said terminal passages of said terminal housing and having a first mating end having at least one spring arm, with a normally relaxed first position, directed toward a respective reaction surface of said outer housing, whereby upon relative movement of said terminal housing and said outer housing each said arm being deflected to a second position allowing insertion of a terminal post into said connector without application of force.

2. A zero insertion force connector according to claim 1 wherein said outer housing has a generally rectangular profile formed by spaced side walls and end walls defining said cavity, further comprising means to secure said actuator plate in said cavity without relative movement therebetween.

3. A zero insertion force connector according to claim 2 wherein said means to secure said actuator plate in said cavity comprises:

a plurality of parallel spaced legs extending rearwardly from each said side wall, each said leg having an inwardly directed shoulder adjacent the free end thereof; and an outwardly directed shoulder on each side of said actuator plate engaged by respective shoulders of said legs.

4. A zero insertion force connector according to claim 2 wherein said end walls have an inwardly directed channel profile to guide relative movement of said terminal housing with respect to said outer housing.

5. A zero insertion force connector according to claim 3 further comprising:

a plurality of spaced extensions on said terminal housing defining a plurality of spaces which receive said legs whereby said terminal housing is guided for relative movement with respect to said outer housing.

6. A zero insertion force connector according to claim 1 further comprising:

at least one cam surface on each opposed side of said cam follower; and at least one cam surface within said cavity of said actuator plate aligned to engage a respective cam surface of said cam follower.

7. A zero insertion force connector according to claim 1 further comprising:

a cam shaft integral with said cam follower and positioned to be acted upon by said cam member to produce relative longitudinal movement with respect to said outer housing.

8. A zero insertion force connector according to claim 1 further comprising:

means for remotely actuating said cam.

9. A zero insertion force connector according to claim 1 further comprising:

a second mating end on each said terminal for making engagement with circuitry of a circuit board.

* * * * *